United States Patent [19]

Howard

[11] Patent Number: 4,475,476

[45] **Date of Patent: * Oct. 9, 1984**

[54] SIGNAL STAFF FOR A PERSON IN THE WATER

[76] Inventor: Thomas L. Howard, 1972 Scudder Dr., Akron, Ohio 44320

[ * ] Notice: The portion of the term of this patent subsequent to Nov. 22, 2000 has been disclaimed.

[21] Appl. No.: 291,434

[22] Filed: Aug. 10, 1981

[51] Int. Cl.[3] ..... G09F 17/00

[52] U.S. Cl. ..... 116/210; 116/173; 116/202; 441/18; 441/20; 441/89

[58] Field of Search ..... 116/210, DIG. 9, DIG. 44, 116/202, 209, 173, 306; 441/89, 20, 18, 16, 13, 11, 30, 6, 8, 80, 88

[56] References Cited

U.S. PATENT DOCUMENTS

| | | | |
|---|---|---|---|
| 1,285,940 | 11/1918 | Chodakowski | 116/DIG. 9 X |
| 2,842,090 | 7/1958 | Samwald | 116/210 |
| 2,896,067 | 7/1959 | Lockwood | 116/DIG. 44 X |
| 3,638,258 | 2/1972 | Black | 441/89 |
| 3,721,983 | 3/1973 | Sherer | 116/210 X |
| 3,877,096 | 4/1975 | Scesney | 116/209 X |
| 4,044,711 | 8/1977 | Jamison | 116/DIG. 9 X |
| 4,416,212 | 11/1983 | Howard | 116/210 |

FOREIGN PATENT DOCUMENTS

| | | | |
|---|---|---|---|
| 651692 | 11/1962 | Canada | 116/210 |
| 2807253 | 8/1978 | Fed. Rep. of Germany | 441/11 |
| 2403804 | 5/1979 | France | 116/210 |
| 1403120 | 8/1975 | United Kingdom | 116/209 |
| 2039120 | 7/1980 | United Kingdom | 441/13 |
| 394259 | 12/1973 | U.S.S.R. | 441/18 |
| 472862 | 6/1975 | U.S.S.R. | 441/89 |

*Primary Examiner*—Gerald Goldberg
*Assistant Examiner*—Tom Noland
*Attorney, Agent, or Firm*—Reese Taylor

[57] ABSTRACT

A signal device for indicating, by day or by night, the location of a person adrift on the surface of a body of water, consisting of a vividly colored inflatable tube made of thin, flexible but nearly inextensible material, provided with a one-way valve for inflation by mouth, and a miniature electric lamp coupled to a water-activated battery. The tube is permanently attached to a life jacket or other garment and has a flag secured to its free end. The tube or the flag or both contain a metallic pigment or are covered with a layer of such material so as to be radar detectable.

6 Claims, 7 Drawing Figures

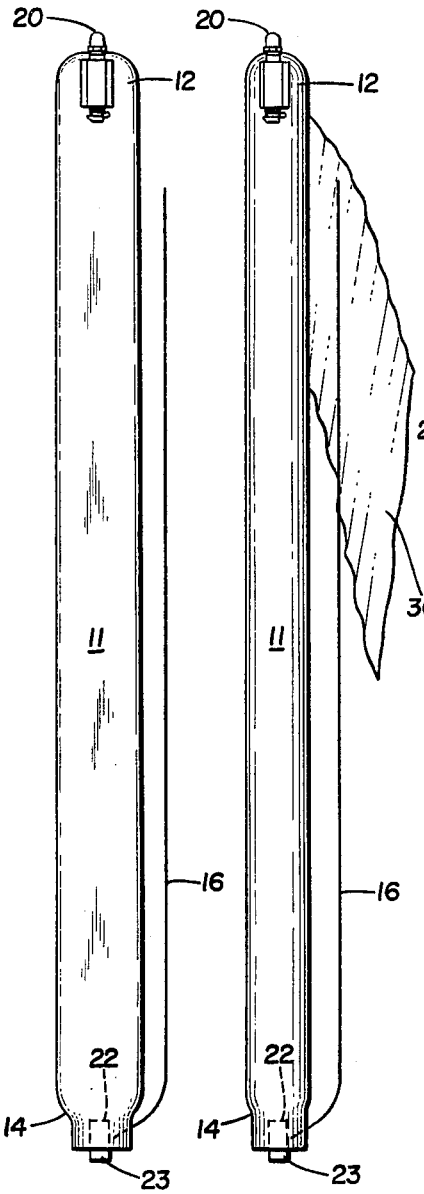
FIG. 1
FIG. 2
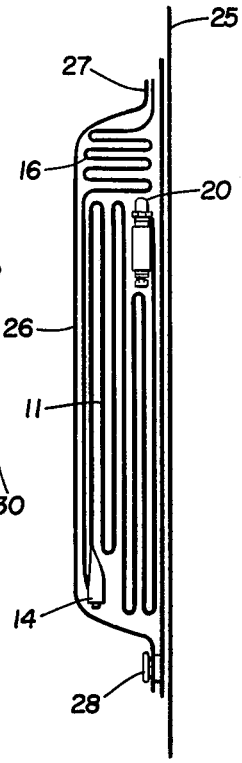
FIG. 5
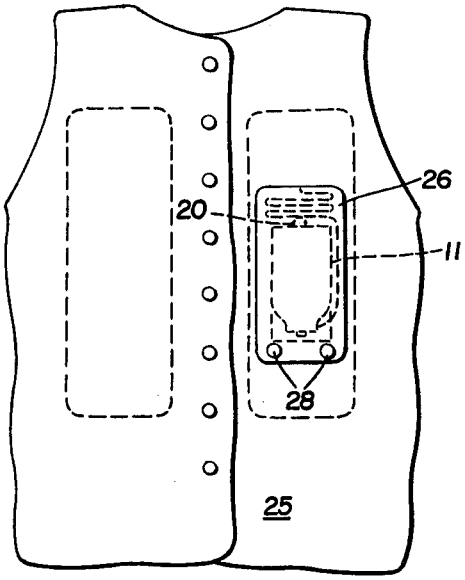
FIG. 6
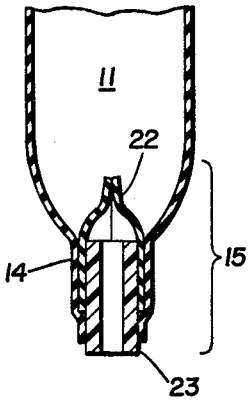
FIG. 3
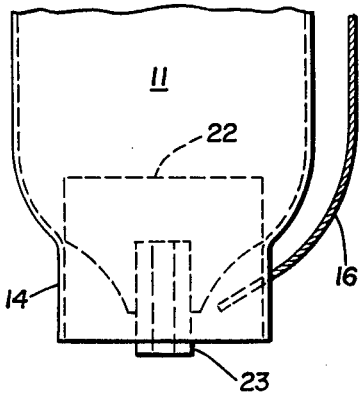
FIG. 4
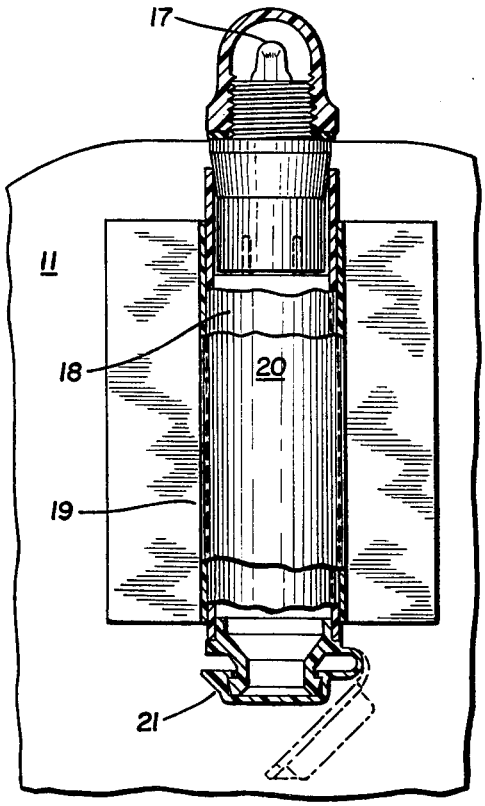
FIG. 7

SIGNAL STAFF FOR A PERSON IN THE WATER

CROSS-REFERENCES TO RELATED APPLICATIONS

This application is related to copending application Ser. No. 258,644 filed Apr. 29, 1981 and now U.S. Pat. No. 4,416,212.

SUMMARY OF THE INVENTION

This invention is a compact signal staff, which is simple, reliable, and highly visible by day or by night. Such a device can be permanently attached to the clothing of every person on a small water craft, and be stowed in a pocket. In the event that the person is cast into the water, the signal staff can be removed from the pocket and can be extended so as to be visible to rescuers either by day or by night.

GENERAL DESCRIPTION

The invention consists basically of a tube of lightweight, impervious, flexible material which can be folded into a compact shape easily stowed in a pocket, until needed. The tube is made rigid by blowing into it until the pressure is sufficient to keep it distended.

The tube is preferably made of a combination of vivid colors, such as yellow and red, for easy visibility during daylight, and is provided with a tiny water-activated lamp for visibility at night.

A lanyard attached to the tube of the inflatable signal staff, and to the pocket in which it is stored, prevents loss of the device by the user, when he is cast adrift.

THE DRAWINGS

In the accompanying drawings:

FIG. 1 is a reduced scale view showing the signal staff as it appears with the tube flattened.

FIG. 2 is a similar view showing the signal staff with the tube rounded by inflation, and also showing an optional flag.

FIG. 3 is a sectional view on a larger scale showing a simple form of one-way valve for receiving inflation air and preventing it from escaping.

FIG. 4 is a phantom representation of the valve of FIG. 3 at a right angle to FIG. 3.

FIG. 5 is an approximately full size sectional view of the signal staff folded and stored in a pocket of a garment.

FIG. 6 shows a preferred location of a pocket on a life jacket for storage of the folded signal staff.

FIG. 7 is an enlarged showing of a water-activated battery and a signal light attached to it for night-time signaling of the user's location.

THE PROBLEM

The signal staff of this invention is intended to be a standard part of the life jacket worn by every person on a speed boat or similar water craft, and especially by those on a boat in the ocean or on a large lake where waves of substantial size are normally encountered.

When a person who is fishing, or just pleasure boating, on a fair size body of water, and finds himself in the water, and becomes separated from his boat by more than a very small distance, his head will tend to be below the top of the waves most of the time.

It is then very difficult for a person in a boat to see the person in the water, and particularly so at night.

THE SOLUTION OF THE PROBLEM

The solution of the problem is three-fold. It involves provision of different highly visible or otherwise discernible signals for daytime use and for night-time use; and it involves also presentation of the signal above the crests of ordinary waves.

The first two requirements of providing a signal of a highly visible kind, are dealt with by providing an inflatable staff of a vivid color contrasting with that of the water, preferably with a water-repellant flag of a different bright color for maximum visibility for daytime use; and by providing a very small, light-weight water-activated lamp for night-time use.

In either case, the signal is made several feet long so that it can be held above waves of normal height.

For daytime use, the staff is made of a vivid color contrasting with the color of water; preferably bright yellow, since the water normally reflects the blue or gray color of the sky, so that a bright red or orange or yellow color is needed.

For night-time use, the signal is provided with a very small lamp which is activated by water. Even a very small light is easily visible over a great distance in contrast to the darkness of night.

In any case, the signal is made as compact and light in weight as possible, consisting of an inflatable staff made of thin and light film material which is strong and resistant to tear, of which many kinds are available; or of light but strong and tear-resistant cloth impregnated with a water-repellant flexible material; and is made of a length as great as will permit easy manipulation by a person floating in the water, so that it can be held up to be visible above normal wave height.

DETAILED DESCRIPTION

The signal staff of this invention is basically a vividly colored inflatable tube, which can be made by extruding a thin tube of weather-proof flexible but essentially inextensible plastic, or by heat-sealing a thin sheet of such material or of waterproof coated light but strong cloth, to produce a tube of suitable size. It is preferably folded into a compact package and stowed in an immediately accessible pocket of the user's outer garment.

FIG. 1 is a representation of the signal staff in its extended but flattened condition. It consists of a tube 11 of light but strong, flexible, weather-resistant plastic, or impregnated air-tight cloth, with a diameter of about 3 to 6 inches (8 to 16 cm), and therefore a flat width of about 4½ to 9 inches (12 to 24 cm) and a length of about 3 to 6 feet, or more (1 to 2 or more meters).

An additional benefit is obtained by making the tubular staff, or the flag, or both, of a composition containing a metallic pigment such as flake aluminum, or at least containing a layer of such a composition. Such a material can be very helpful in locating a person in fog, or at night, when visibility by eyesight is virtually impossible, since the metallic pigment is easily detectable over considerable distances by radar.

The tubular material is sealed shut at one end 12, and the other end 14 is sealed to an inflation device 15, which is a simple one-way valve, for inflation by mouth, and is shown in more detail in FIGS. 3 and 4. A lanyard 16 is fastened to end 14, for tethering the staff to the clothing of the user so that it cannot escape from the user in an emergency situation.

Since emergencies can occur in the dark as well as in daylight, the signal staff is provided with a small and light-weight lamp 20 preferably powered by a water-activated source of energy.

As shown in FIG. 7, such a lamp includes a bulb 17 on a casing 19 and is connected to a water-activated battery 18 provided with a water-tight cap 21, and is permanently bonded to the free end of the inflatable tube 11. Such a tiny lamp is useless during daylight, but in the dark of night even a very small lamp can be seen for a great distance if held above wave level. It is accordingly not self-activated, but requires the user, after dark, to open the bottom cap 21 and to fill the battery casing with water. Such a lamp can be made to glow, and to be visible for long distances, for many hours.

In addition, the signal staff is preferably provided at its free end with a flag 30, which may be of a size up to about a third or even a half of the length of the staff, and which also is of a vivid color or colors such as red, orange, or yellow, and preferably a color somewhat different from that of the staff, so that the contrast of color will enhance visibility of the signal.

The lower end 14 of the inflatable staff 11 is sealed airtight to a one-way inflation valve 22 which may consist simply of a flattened tube of thin flexible plastic which opens to admit air blown in through mouthpiece 23, and closes when internal air pressure brings the lips of valve 22 together.

The signal staff is preferably a permanent part of the user's life jacket 25 as shown in FIG. 6. For storage in the life jacket, the inflatable staff 11 is completely deflated, by suction if necessary, and is then folded zigzag, together with lanyard 16, so that the entire signal device will fit snugly in a chest pocket 26 on a standard life jacket 25, or in a similar location in another outer garment, but will unfold without tangling when removed from the pocket. The end of the lanyard 16 is firmly bonded in a seam 27, as shown in FIG. 5, so that the signal staff cannot escape from the user during an emergency.

The pocket 26 opens downward and is closed by firmly engaged but easily opened snap fasteners 28, or preferably a water-excluding fastener consisting of interlocking strips of flexible material, so that the pocket can be easily opened and the folded signal staff can be gripped easily by either hand of the wearer of the life jacket, and easily pulled down, and out of the pocket. Since the lanyard 16 is permanently fastened inside of the pocket 26, the signal staff cannot escape and be lost during the confusion of an emergency situation.

The signal staff is inflated by blowing in the mouthpiece 23 until the internal pressure is sufficient to keep the staff 11 straight and rigid, so that it can be held erect to signal the location of the user.

The signal staff is of value only if it can be seen by a potential rescuer. Accordingly, the inflatable staff should be as long as can be conveniently manipulated by an unskilled person, for holding erect with the tip preferably always above the wave level. Even if the waves are high, a person wearing a life jacket will have his head periodically at the crest of the wave and can then show the signal staff at a level at which it will be easily visible, if of a color contrasting with the color of the water.

It is therefore very important that the signal staff have a maximum contrast with the color of a body of water. The staff is preferably a brilliant red or orange or yellow, such as the internationally recognized emergency orange color.

I claim:

1. An emergency signalling device for use with a life jacket, comprising:

(A) an elongate, relatively thin, unitary, extruded, flexible tube having first and second ends and constructed of relatively thin, flexible but nearly inextensible material;

(B) a signal light attached to said first end;

(C) a water activated battery
  (1) disposed on said tube and
  (2) operatively connected to said signal light;

(D) means for selectively actuating said battery;

(E) said tube being collapsible for storage within a pocket of the life jacket;

(F) said second end of said tube comprising a mouthpiece and one-way valve means attached thereto comprising a flattened tube of thin, flexible plastic openable by air pressure whereby said tube may be inflated by blowing into said valve means to form said tube into a semirigid elongate configuration extending along a single axis from said first to said second end;

(G) a lanyard having
  (1) first and second ends,
  (2) said first end being permanently attached to said second end of said tube and
  (3) said second end being permanently attached to said life jacket; and (H) said tube being of a brilliant color.

2. A signalling device as in claim 1, folded and stowed in an accessible protective pocket; said pocket being normally closed.

3. A signalling device as in claim 1, including a flag of a contrasting vivid color secured to said first end of said tube.

4. A signalling device as in claim 3 wherein said flag is a contrasting vivid color and is disposed on the first end of the tube.

5. A signalling device as in claim 1 wherein said flag is made, at least in part, of a composition containing a metallic pigment.

6. A signalling device as in claim 1 wherein said tube is made, at least in part, of a composition containing a metallic pigment.

* * * * *